US005083938A

United States Patent [19]

Poliak

[11] Patent Number: 5,083,938

[45] Date of Patent: Jan. 28, 1992

[54] POSITIVE RETENTION ELECTRICAL CONNECTOR

[75] Inventor: John M. Poliak, East Meadow, N.Y.

[73] Assignee: Leviton Manufacturing Co. Inc., Little Neck, N.Y.

[21] Appl. No.: 715,942

[22] Filed: Jun. 14, 1991

Related U.S. Application Data

[63] Continuation of Ser. No. 608,129, Nov. 1, 1990, abandoned.

[51] Int. Cl.[5] ..... H01R 13/58

[52] U.S. Cl. ..... 439/460; 439/469

[58] Field of Search ..... 439/101, 106, 460, 461, 439/462, 469, 736, 782

[56] References Cited

U.S. PATENT DOCUMENTS 3,437,980 4/1969 Smith ..... 439/469
4,402,565 9/1983 Poliak ..... 439/460
4,640,568 2/1987 Magourou ..... 439/460
4,874,332 10/1989 Munroe ..... 439/460 X

*Primary Examiner*—Eugene F. Desmond
*Attorney, Agent, or Firm*—Paul J. Sutton

[57] ABSTRACT

A connector for conductively connecting a wire to a receptacle. The connector includes a hollow body having an axial bore for receiving the wire in an axial position and a housing adapted to be received in the body. Fingers on the housing urge the fingers against the wire radially inwards against shoulders on the body to axially position the wire as the housing is inserted into the body. Included is a system for connecting each of the three conductors of the stripped wire with the electrical prongs of the connector. The system includes brackets slidably mounted with the connector proximate to the prongs and which form cavities for receiving the conductors and screws for moving the brackets towards the prongs to capture the conductors in the cavities.

4 Claims, 6 Drawing Sheets

POSITIVE RETENTION ELECTRICAL CONNECTOR

This is a continuation of application Ser. No. 608,129 filed Nov. 1, 1990, now abandoned.

BACKGROUND OF THE INVENTION

This invention pertains to electrical connectors for electrically connecting a conductive wire to an electrical apparatus or source of electrical potential. More specifically, the invention relates to a connector on which there can be mounted terminals for connection to the respective conductors of a wire with the wire retained in the connector to prevent mechanical stress due to relative movement between the connector and wire on the connections between the conductors and terminals.

It is known in the art to provide mechanical stress relief between a wire and a connector to which the wire is attached by mechanically attaching the wire or its insulation to the connector body. In some wire and connector combinations of the prior art the exterior insulation on the wire and the body of the connector are fused together to mechanically join the wire and connector body and thereby provide stress and strain relief at the junction of the wire conductors with the connector terminals. Since this method of attachment is a permanent one, the connectors on such wires cannot be disconnected from the wire and reused. Electrical failure within such connectors must be corrected by replacement of the entire wire and connector assembly or substitution of a different type of connector. Connectors adapted for permanent attachment can also not be sold separately from the wires with which they are used for attachment by a user. Hence, from a commercial point of view they have limited market potential.

There is known in the art another type of connector which can be manually connected to and removed from a wire for reuse and which provides mechanical stress and strain relief between the conductors of the wire and the electrical terminals supported in the connector. Such connectors generally have a hollow cylindrical neck formed from a compressible material. The wire is received in the connector through a bore in the hollow neck and the neck is then compressed about the wire to form a frictional coupling between the wire and connector by means of a yoke which is circumscribingly mounted on the periphery of the neck of the connector and tightened to compress the neck against the wire to form the frictional coupling. To perform its intended function, the yoke used must be made of a hard rigid material which is usually a metal such as aluminum or steel. When the yoke is tightened it literally crushes the cylindrical neck on the connector and can damage it. Since the neck of the connector also serves as a means for grasping the connector, the yoke can interfere with the comfortable grasping of the connector. Moreover, since the yoke is often metallic and, therefore conductive, it presents a potential danger should the neck of the connector fracture and a live conductor in the wire come into contact with the yoke while it is being grasped by the user. The use of such yokes is also unsightly and presents a crude appearance in contrast to the neat finish of integrally molded connector and wire assemblies.

SUMMARY OF THE INVENTION

It is therefore an object of the instant invention to provide an electrical connector having means for mechanical coupling with a wire to be received in the connector for relieving stress and strain at the electrical connections between the terminals in the connector and the conductors of the wire.

Another object of the invention is to provide an electrical connector which can be manually connected and disconnected from a wire for use and reuse without need for special tools or skills.

Still another object of the invention is to provide an electrical connector suitable for frictionally retaining a wire without deforming the body of the connector.

A further object of the invention is to provide an electrical connector having a body which is suitable both for retaining a wire in the connector and supporting the terminals of the connector with a minimum number of fasteners.

Other and further objects of the invention will be apparent from the following drawings and description of a preferred embodiment of the invention in which like reference numerals are used to designate like parts in the various views.

DESCRIPTION OF THE PREFERRED EMBODIMENT

Figures 1, 2, 3:
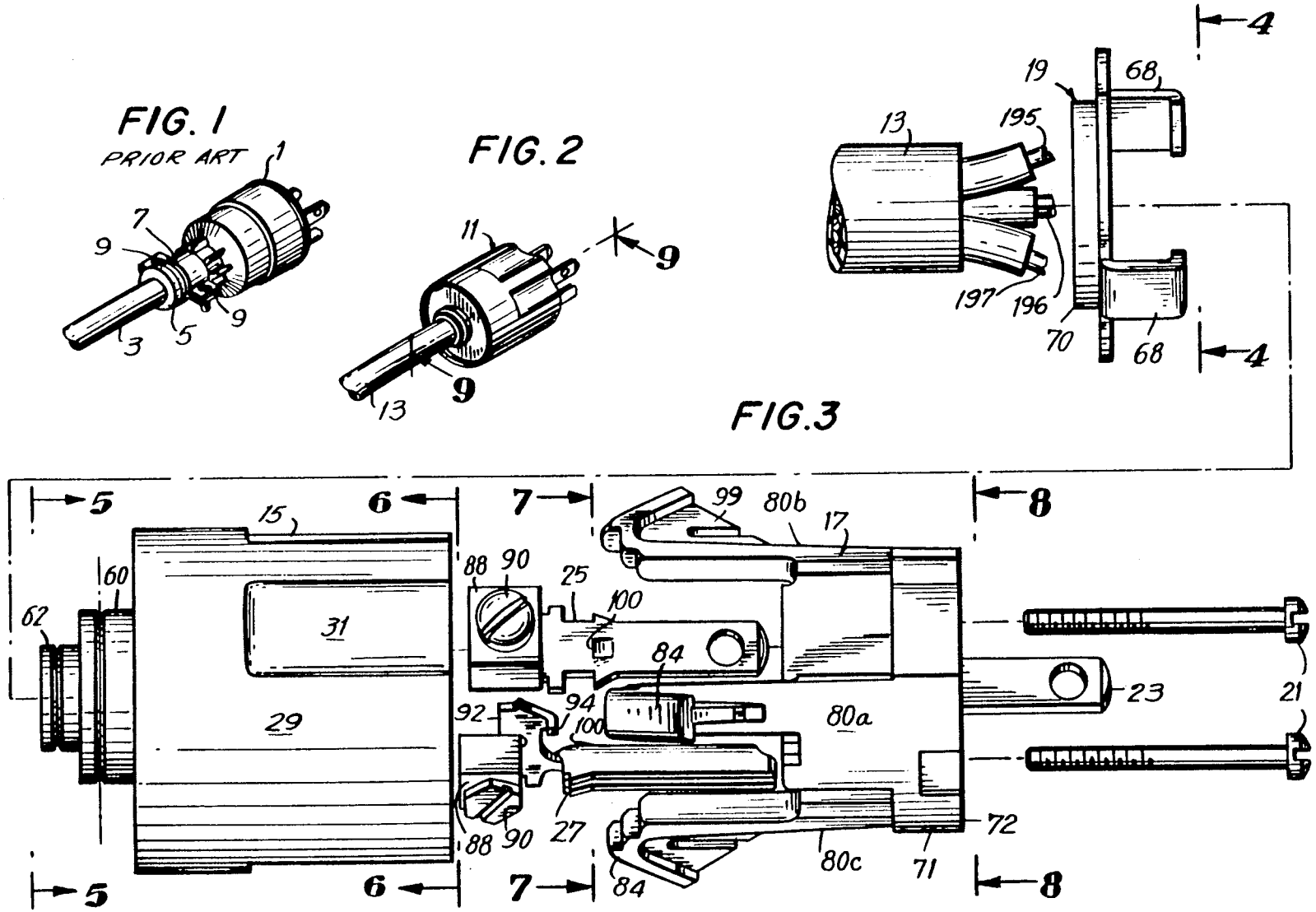
FIG. 1 PRIOR ART
FIG. 1 is a perspective view of an electrical connector known to the prior art and assembled with a wire for use in its intended environment.
FIG. 2 is a perspective view of a connector in accordance with the preferred embodiment of the invention assembled to a wire for use in its intended environment.
FIG. 3 is an exploded side elevation of the connector of the preferred embodiment of the invention.

Referring now to FIG. 1 of the drawings, there is shown an electrical connector 1 in accordance with the prior art to which there is connected a wire 3. The body of the connector 1 has a neck 5 to which there is circumsribingly fastened a yoke 7. The yoke 7 includes two members held together by screws 9 which are tightened to compress the yoke 7 about the neck 5 thereby compressing the neck 5 against the exterior surface of the wire 3. As can be seen from FIG. 1, the yoke 7 is in a position where it is likely to be touched by the hand of a person connecting or disconnecting the connector 1 to or from an electrical outlet (not shown). Also because of the disposition of the screws 9, pressure is applied to the neck portion 5 of the connector 1 and to the wire 3 in the vertical direction as shown in FIG. 1 but not in the horizontal direction. This uneven pressure on the wire 3 results in a flattening of the wire and the neck portion 5 and can cause the neck portion 5 and/or wire 3 to fracture or wear more rapidly than would be the case in the absence of the yoke 7.

A connector 11 in accordance with the preferred embodiment of the invention is shown in FIG. 2 connected to a wire 13. As can be seen, the absence of the yoke 7 from the connector of the preferred embodiment of the invention shown in FIG. 2 makes for a neater appearance and allows the wire 13 to be free of potentially damaging forces along its length exterior to the connector 11.

Referring now to FIG. 3 of the drawings, the connector 11 includes a body 15 in the form of a hollow shell, a housing 17 adapted to be received within the hollow of the body 15, a retaining ring 19 adapted to be mounted on the posterior end of the body 15 and two screws 21 which serve to hold the retaining ring 19, body 15, and housing 17 together as will subsequently be shown.

The housing 17 is bored to support three electrical terminal prongs which permit the connector 11 to function as a standard grounding plug. The prongs which comprise the electrical terminal include a line prong 23, a neutral prong 25 and a grounding prong 27.

Figure 6:
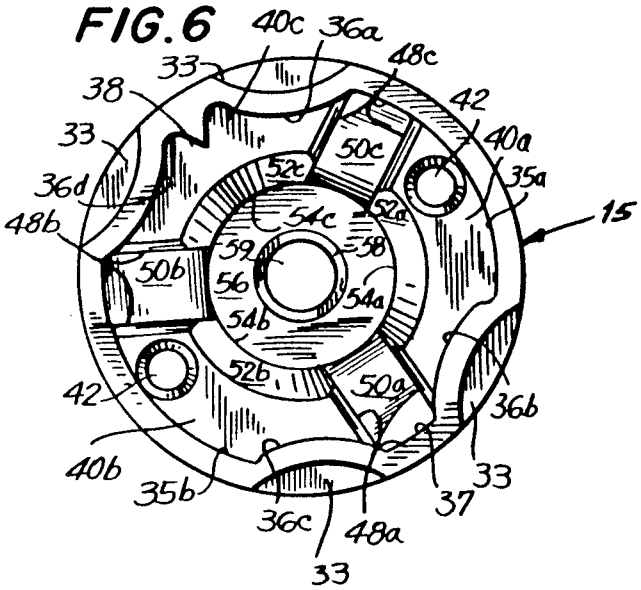
FIG. 6 is an end view of the component of the invention shown in FIG. 5 but taken facing the opposite end of the component.

The body 15 of the connector 11 will now be described with reference to FIGS. 3, 5, and 6. The body 15 is made of an insulating material which preferably has some resilience such as rubber. The body 15 has a substantially cylindrical outer wall 29 in which there are formed longitudinal indentations 31 which extend axially rearwardly from the anterior end of the body 15. The indentations 31 terminate at their posterior ends in shoulders 33 which cooperate with the indentations 31 to provide a grasping surface for holding the connector 11 as it is inserted or removed from a mating connector (not shown) in such as a wall receptacle. As can be seen in FIG. 6 of the drawings, the body 15 has an enlarged bore at its interior end defined by concave walls 35*a* and 35*b*, convex walls 36*a*, 36*b*, 36*c* and 36*d*, a substantially planar wall 37 and a keying wall portion 38 having a substantially triangular cross-section. The convex walls 36*a–d* and portions of the concave walls 35*a*, 35*b* terminate posteriorly at spaced shoulders 40*a*, 40*b* and 40*c* which serve as seats for the housing 17. Through holes 42 are bored in the shoulders 40*a* and 40*b* and terminate within pentagonal recesses 44 (FIG. 5) in the posterior major surface 46 of the connector body 15. Between the shoulders 40*a*, 40*b* and 40*c* there are defined axial channels having adjacent wall portions 48*a* (coincident with planar wall 37), 48*b* and 48*c* which terminate posteriorly in shoulders 50*a*, 50*b* and 50*c* which are situated rearwardly of the shoulders 40*a*, 40*b* and 40*c*.

The shoulders 40*a*, *b* and *c* terminate at their radially inward extremities in posteriorly radially inward sloping engaging surfaces 52*a*, 52*b* and 52*c* respectively. The engaging surfaces 52*a*, 52*b* and 52*c* terminate posteriorly at axially posteriorly extending cylindrical wall portions 54*a*, 54*b* and 54*c* which run between the channels 48*a*, *b* and *c* and in turn terminate at a circular shoulder 56 through which there is an axial cylindrical bore extending rearwardly to a posterior circular shoulder 58. The shoulder 58 circumscribes a smaller diameter cylindrical bore 59 which extends to the posterior end of the connector body 15.

Figure 5:
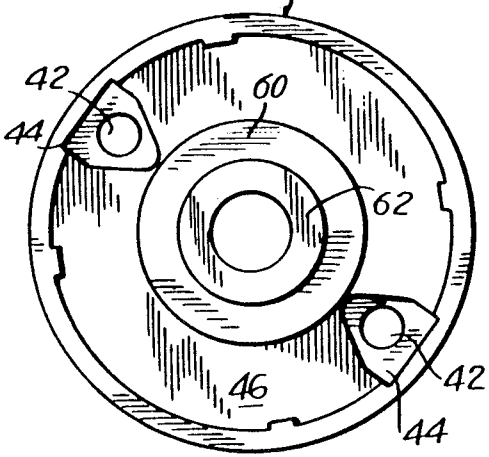
FIG. 5 is an end vied of another component of the apparatus of the preferred embodiment of the invention taken through line 5—5 of FIG. 3.
Figure 4:
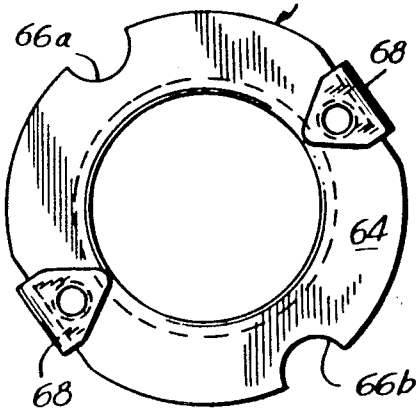
FIG. 4 is an end view showing a component of the apparatus of the preferred embodiment of the invention taken through line 4—4 of FIG. 3.

As shown in FIG. 5, extending from the posterior major surface 46 of the body 15 is an integral cylindrical boss 60 and coaxial with it is a smaller cylindrical boss 62 circumscribing the bore 59 which is adapted to receive the three conductor wire 13. The major surface 46 at the posterior end of the body 15 is slightly recessed within the surrounding posterior cylindrical wall to provide a seat for the retaining ring 19 which will now be described with reference to FIGS. 3 and 4.

The retaining ring 19 is preferably made of a rigid metal such as aluminum or steel although any other substantially rigid material will suffice. The ring 19 has an anterior planar surface 64 which is notched at 66*a* and 66*b* to accept a tool for separating the retaining ring 19 from the body 15. Extending anteriorly of the surface 64 at diametrically opposite edges of the retaining ring 19 are projections 68 each of which has a planar portion parallel to the axis of the ring 19 and a radially inwardly directed pentagonal portion of dimensions suitable for seating within the pentagonal recesses 44 in the connector body 15. The pentagonal portions of the projections 68 are apertured and threaded to receive the threaded portions of the screws 21. Surroundingly the central aperture of the ring 19 is a cylindrical flange 70 which is of inner diameter substantially equal to the outer diameter of the boss 60 extending from the posterior major surface 46 of the connector body 15 and which circumscribes the boss 60 when the ring 19 is seated on the posterior end of the connector body 15 with the projections 68 received in the recesses 44.

Figure 8:
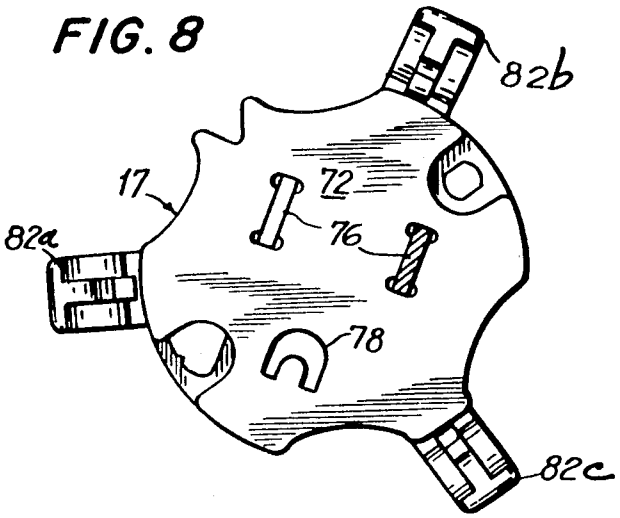
FIG. 8 is a sectional end view showing the components shown in FIG. 7 but taken along the line 8—8 of FIG. 3.
Figure 7:
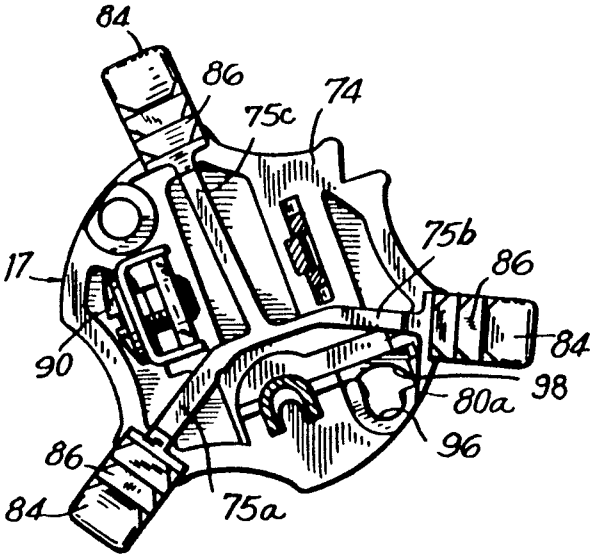
FIG. 7 is a sectional view showing other components of the apparatus of the preferred embodiment of the invention taken through line 7—7 of FIG. 3.

The housing 17 will now be described with reference to FIGS. 3, 7 and 8. The housing 17 includes a forward portion 71 having a substantially planar anterior surface 72 and an irregular posterior surface 74 from which there axially posteriorly extend three intersecting partitions 75*a*, 75*b* and 75*c*. The planar portion 71 of the housing 17 has two displaced axial bores 76 of I cross-section which are adapted to snuggly receive the terminal prongs 23 and 25 and a bore 78 of U cross-section which is adapted to snuggly receive the grounding terminal prong 27.

Extending axially posteriorly from the outer circumference of the forward portion 71 of the housing 17 are circumferential wall sections 80*a*, 80*b* and 80*c*. Extending axially posteriorly and radially inwardly from the posterior regions of the housing wall portions 80*a, b* and *c* are resilient finger, or prong, members 82*a*, 82*b* and 82*c*. The prong members 82*a, b* and *c* each have an axially posteriorly radially outward facing cam surface 84 and an axially posteriorly and radially inwardly facing friction surface 86. The friction surfaces 86 have a serrated cross-section and are adapted to frictionally engage the outer insulation on the wire 13 when urged against the surface in a manner to be subsequently described.

The housing 17 is preferably made of a substantially rigid plastic although other insulating materials having similar rigidity characteristics can be used. The prong members 82*a, b* and *c* and integrally formed with the housing 17 and are thin walled at their junction with the posterior ends of the housing portions 80*a, b* and *c* so that they can bent inwardly when an axial force is applied to their respective cam surfaces 84. The prong members 82*a, b* and *c* are notched at their edges 99 opposite the friction surfaces 86 to allow flexing between the cam surfaces 84 and the portions of the prong members 80*a, b* and *c* to prevent fracture of the prong members 82*a, b* and *c* upon application of excessive force to the cam surfaces 84.

The terminal prongs 23, 25 and 27 have anterior ends adapted to extend from the anterior surface 72 of the housing 17 for insertion into aligning complementary receptacles (not shown) and posterior ends which are apertured and threaded and over which there are mounted U-shaped brackets 88 which are held in place by screws 90 which are threaded into the apertures at the posterior ends of the respective terminal prongs 23, 25 and 27.

The grounding terminal prong 27 has, at its posterior end, an integral extension 92 having a transverse flange 94 with a curved edge adapted to enclose a seimcylindrical groove formed in the housing wall portion 80*a* at 96. A cylindrical sleeve 98 having an axis parallel to the axis of the connector 11 is integrally formed in the housing 17 diametrically opposite the groove 96.

To assemble the connector 11 with the wire 13, the prong terminals 23, 25 and 27 are inserted into their respective bores 76 and 78 in the housing 17 and the retaining ring 19 is placed over the bosses 62 and 60 of the body 15 with its projections 68 received in the recesses 44 of the body 15 and its cylindrical flange 70 circumscribing the boss 60. The wire 13, with part of its outer insulation striped away to expose the three conductors of the wire is then inserted through the posterior end of the central axial bore in the connector body 15 and is extended from the anterior end of the body 15. The conductive core portions of the conductors in the wire 13 are then attached by means of the U brackets 88 and screws 90 to the respective terminal prongs 23, 25 and 27, that is, with the phase wire going to the prong 23, the neutral wire going to the prong 25 and the grounding wire going to the prong 27.

The housing 17 with the terminal prongs 23, 25 and 27 inserted in their respective bores is then inserted into the body 15 in the axial direction until the cam surfaces 84 of the prongs 82*a, b* and *c* engage the engaging surfaces 52*a, b*and *c* of the body 15. The housing 17 is then pushed farther into the body 15 thereby causing the prong members 82*a, b* and *c* to be forced radially inwardly toward the outer circumference of the wire 13 with the friction surfaces 86 being urged into the insulation on the wire 13 to frictionally prevent movement of the wire 13 relative to the housing 17. The housing 17 is pushed fully into the body 15 until the prong members 82*a, b* and *c* reach the ends of the channels 50*a*, 50*b* and 50*c* by which time the anterior surface 72 of the housing 17 is flush with the anterior end of the body 15.

The screws 21 are then inserted through apertures at the anterior end of the housing 17 which are in alignment respective with the groove 96 and cylindrical sleeve 98 in the housing 17. The screws 21 pass through the apertures 42 in the body 15 and are then threaded into the threaded apertures in the projections 68 of the retaining ring 19 to complete the assembly of the connector 11.

Figure 10:
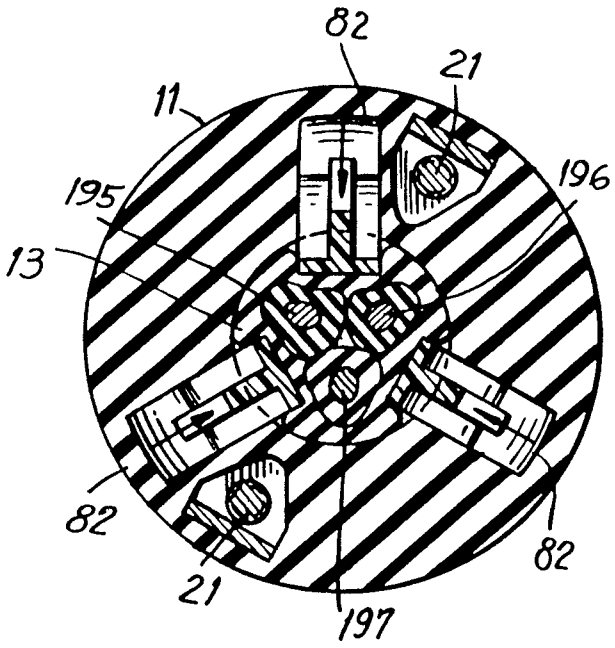
FIG. 10 is a cross-sectional view of the apparatus of the preferred embodiment of the invention taken along line 10—10 of FIG. 9.
Figure 9:
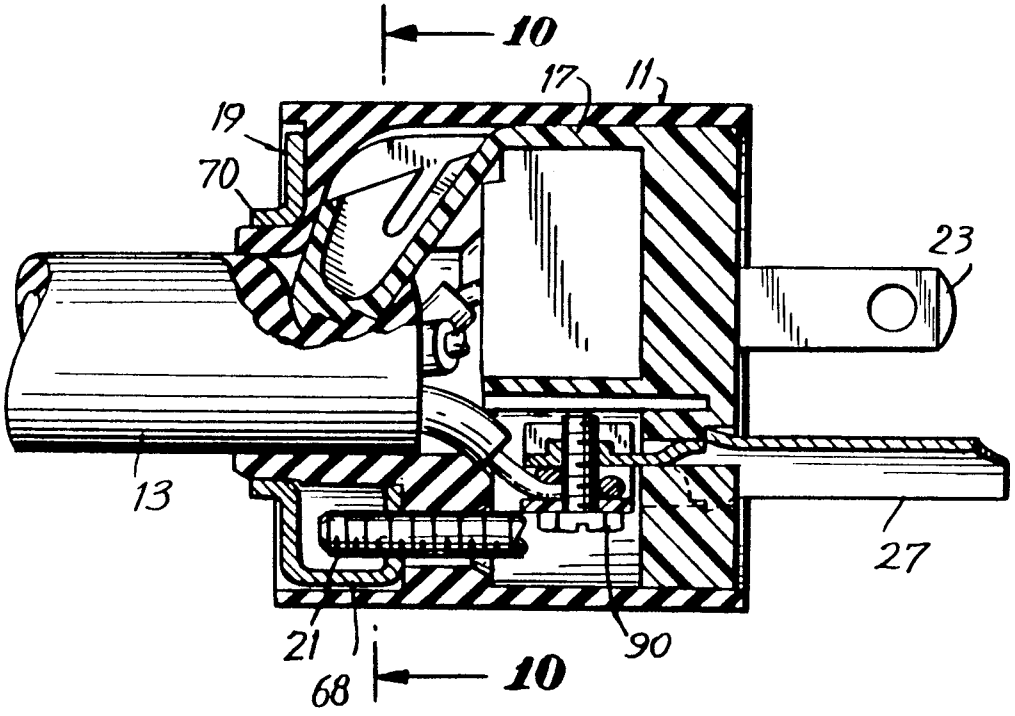
FIG. 9 is a side sectional elevation of the apparatus of the preferred embodiment of the invention taken along line 9—9 of FIG. 2.

As can be seen in FIGS. 9 and 10, once assembly of the connector 11 has been completed in the above-described manner with the wire 13 inserted therein, the wire 13 is compressed by the prong members 82*a, b* and *c* thereby providing a positive retention of the wire 13 in the connector 11 without need for the use of clamps or braces to crush any portion of the body member 15 about the wire 13. In addition, the grounding terminal prong 27 is making contact with the head of the screws 21 as seen in FIG. 3 due to the interlocking relationship between the curved surface on the transverse flange 94 of the prong 27 and the threads on the engaged screw 90. Shoulders formed on the prongs 23, 25 and 27 limit their axial movement in an anterior direction and a small ramp defining a shoulder 100 on each of the terminal prongs prevents axial movement of the prongs in a posterior direction. The retaining ring 19 is grounded as a result of the high conductance path to the grounding prong 27 and its associated grounding wire provided by the screw 21 which is in contact with the terminal prong 27.

Figure 11:
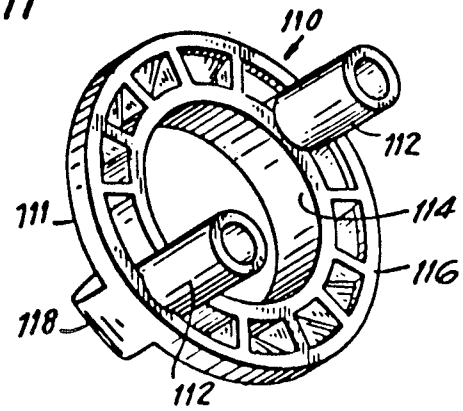
FIG. 11 is a perspective view of an alternate embodiment of the component shown in FIG. 4.

As can bee seen in FIG. 11 an alternate retaining ring 110 is illustrated. The alternate retaining ring 110 is preferably made of a rigid plastic such as nylon or the like. The ring 110 has an anterior cellular surface 116. Extending anteriorly off the surface 116 and at diametrically opposite edges of the ring 110 are a pair of cylindrical projections 112. The pair of cylindrical projections 112 are threaded to receive the threaded portions of the screws 21. The central aperture of the ring 110 is defined by a cylindrical surface 114 which is of inner diameter substantially equal to the outer diameter of the boss 60 extending from the posterior major surface 46 of the connector body 15 and in which circumscribes the boss 60 when the ring 110 is seated on the posterior end of the connector body 15. The pair of cylindrical projections 112 are received in recesses 44. Additionally, each of the pair of cylindrical projections 112 are capped at the posterior surface of the ring 110 by a shoulder 118. The ring 110 also possesses a sloping planar surface 111 as its posterior end which is best seen in FIG. 12 and FIG. 13.

Figure 12:
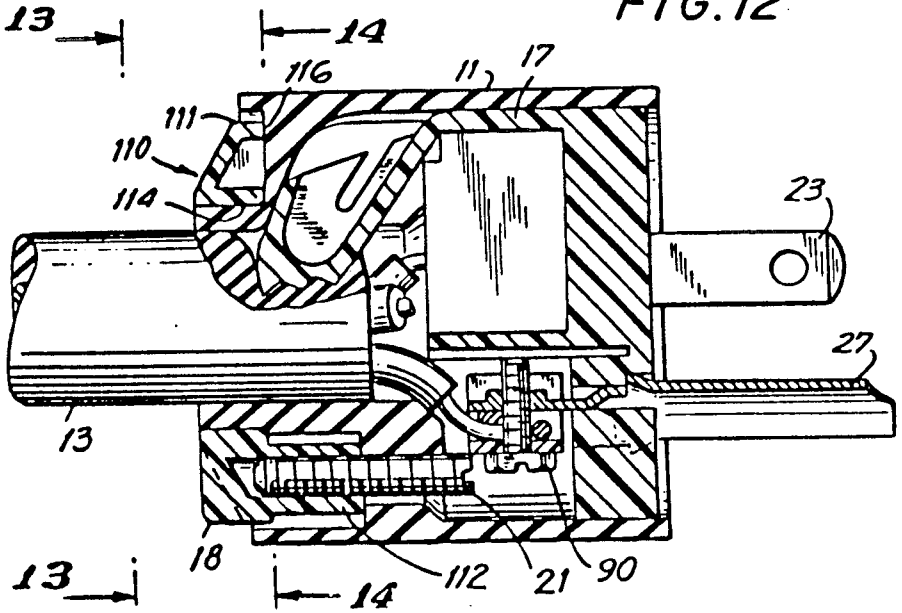
FIG. 12 is an exploded side elevation view of the apparatus of the invention incorporating the alternate embodiment of FIG. 11.

FIG. 12 is similar in description to the foregoing description of FIG. 9 and the difference being the use of the alternate retaining ring 110 in the assembly rather than the retaining ring 19. The use of the alternate retaining ring 110 obviates the need for the grounding of retaining ring 19 provided by the screw 21. Since alternate retaining ring 110 is formed of non conducting plastic there is no need to ground ring 110 by means of the screw 21. The sloping surface 111 provides the transition from the inner central portion of the connector body 15 to the outer peripheral portion of the connector body 15.

Figure 13:
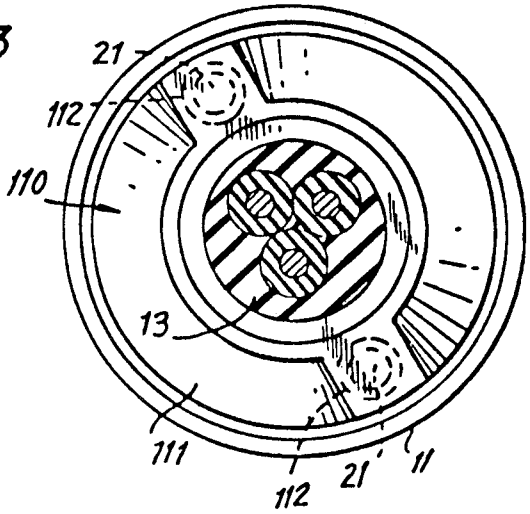
FIG. 13 is an end view of the apparatus or the alternate embodiment of the invention taken through line 13—13 of FIG. 12.

Shown in FIG. 13, which is a section taken through line 13—13 of FIG. 12, is the alternate retaining ring 110 fastened to the connector 11 by the screws 21. The sloping surface 111 presents a uniform continuous closure to the posterior end of the connector 11 shown in FIG. 12.

Figure 14:
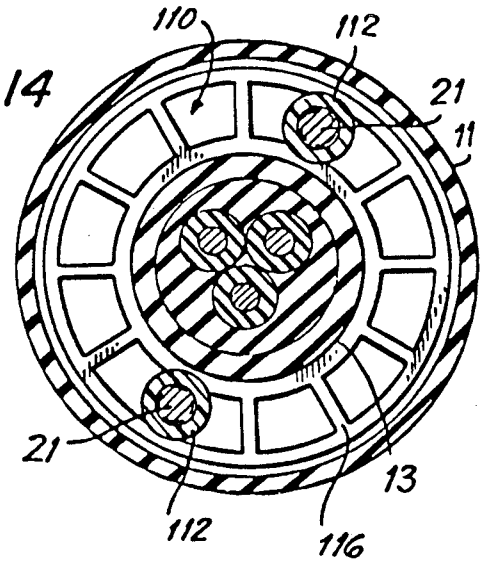
FIG. 14 is a sectional view of the apparatus or the alternate embodiment of the invention taken through line 14—14 of FIG. 12.

FIG. 14, which is a section taken through the line 14—14 of FIG. 12, illustrates the appearance of the alternate retaining ring 110 in the connector 11 shown in FIG. 12. Here seen is the cellular surface 116 as it is assembled in the posterior end of connector 11. Seen here are the screws 21 as they engage the threaded portions of the cylindrical projections 112. Also the position of the wire 13 as it occupies the center opening of the ring 110.

An additional advantage of the use of the alternate retaining ring 110 is that the screws 21 may be of the self tapping variety rather than the threaded variety shown in the hereinbefore described embodiment. When the screws 21 are of the self tapping variety there is no need to provide for threaded portions in the cylindrical projections 112.

FIGS. 15, 16, 17, 18, 19, and 20 illustrate an alternative system 120 for connecting wire 13 with prongs 23, 25, and 27. A prong 122 is shown in perspective in FIG. 15 in an exploded view along with a bracket 124 and a screw 126. Prong 122 is a typical prong that would be used for either the prong 23 or prong 25 discussed earlier. Prong 122 is an elongated bar having opposed flat sides 128 and opposed narrow intersecting edges 130 and having a plug connector portion 132 at an opposed wire mounting portion 134 that as will be seen is connected to bracket 124 and screw 126. Opposed shoulders 136 extending from the edges of mounting portion 134 of prong 122 are adapted to limit movement of prong 122 in slots 76 in housing 17 in an anterior direction because of interior matching blocking shoulders (not shown) in the slots. A single small ramped shoulder 138 extending outwardly from one of the flat sides 128 of prong 122 spaced between and near opposed shoulders 136 towards connector portion 132 is analogous to shoulder 112 mentioned previously with reference to the prior discussion of prongs 23, 25, and 27 is adapted to slide over a matching mount (not shown) in slots 76 and to lock behind the matching mount to limit movement of prong 112 in a posterior direction in slots 76. In a similar manner, opposed ramped shoulders 146 extend from edges 130 in the area of single ramped shoulder 138 and are also adapted to mate with matching shoulders in slot 76 to limit movement of prong 122 in a posterior direction in slots 76.

Prong 112 also forms a threaded hole 142 extending through flat sides 128 of mounting portion 134 spaced proximate from mounting portion end 144. Hole 142 is adapted to threadingly receive screw 126. Screw 126 includes a threaded portion 146, a head 148, and a connecting portion between threaded portion 146 and head 148, which connecting portion forms a sunken circular recess 150. The lead end 152 of threaded portion 146 is flat and the opposed trailing end 154 next to recess 150 is provided with a sharp last interior thread.

Figure 15:
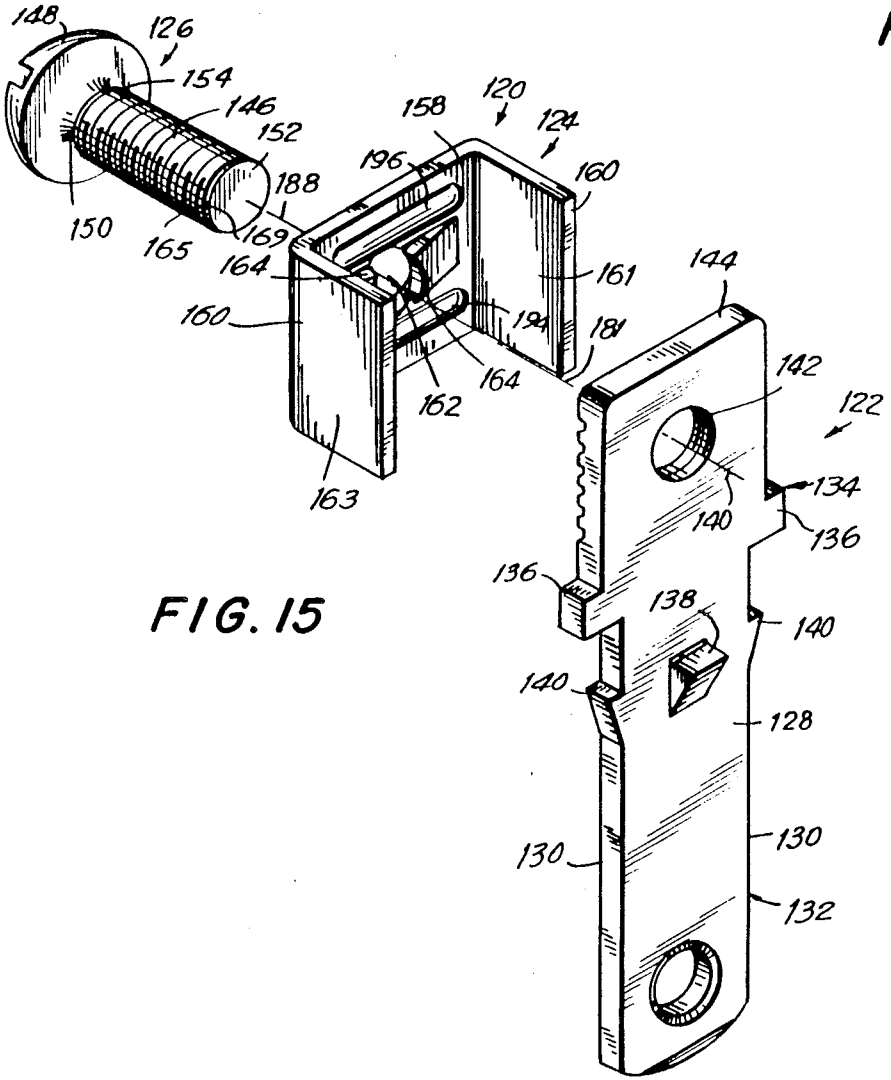
FIG. 15 is a perspective view of the conductor connector system.

As shown in FIG. 15, bracket 124, which is also shown in detail in FIGS. 12, 13, and 14, includes a substantially flat cross-portion 158 that is substantially perpendicular to threaded portion 146 of screw 126 and a pair of wing portions 160 that extend substantially at right angles from either end of cross-portion 158 towards prong 122. The interior distance between wing portions 160 is slightly greater than the width of mounting portion 134 of prong 122, so that wing portions 160 each having opposed parallel inner and outer walls 161 and 163 respectfully, are capable of enfolding mounting portion 124, as is most clearly seen in FIG. 16. Cross-portion 158 defines an apparatus 162 perpendicular across the parallel faces of portion 158 and that is disposed to threadably receive the crown portions 165 of threaded portion 146 or screw 126.

Figure 17:
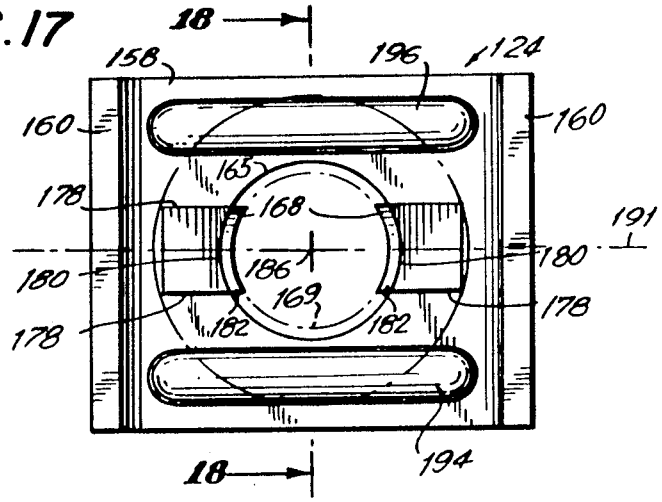
FIG. 17 is a front view taken of the bracket of the conductor connector system including the threaded portion of the screw shown in phantom.

In accordance with the present invention, a pair of opposed external thread members 164 are connected to cross-portion 158 at base portions 166. Members 164 bend inwards from cross-portion 158 into the space between wing portions 160. Thread members 164 include a pair of arcuate facing edges 168 that rae contoured to ride on the valley portions 169 of the threaded portion 146 of screw 126 and so act as external threads to the internal threads of threaded portion 146. Arcuate facing edges 168 are diametrically spaced apart from one another at the distance that the valleys of the threads of the threaded portion 146 are diametrically spaced from one another, except that arcuate facing edges 168 are at approximately the same distance apart so that edges 168 are able to threadingly receive valley portions 169 lead end 152 of threaded portion 146 as best seen in FIG. 17. Thread members 164 have inward walls 170 that are extensions of inward wall 172 of cross-portion 158 facing the space between wing portions 160 and also have outward walls 174 that are extensions of outward wall 176 of cross-portion 158 facing outwardly from the space between wing portions 160. Thread members 164 have opposed side walls 178 of the same thickness as cross-portion 146 and that intersect with inward and outward walls 172 and 176. Arcuate facing edges 168 are positioned on the intersection between inward walls 170 and side walls 178. A second pair of arcuate edges 180 are positioned on the intersection between outward walls 174 and side walls 178. Second arcuate edges 180 are substantially concentric with and spaced outwardly from inner arcuate facing edges 168. A pair of sloping faces 182 are formed on thread members 164 between arcuate facing edges 168 and arcuate outer edges 180; sloping faces 182 are angled inwardly from arcuate outer edges 180 towards inward wall 172 of cross-portion 158 in an orientation will be shortly described.

Aperture 162 is formed through cross-portion 158 that is able to accommodate the passage of threaded portion 146 of screw 126 in threaded accommodation by arcuate facing edges 168 of thread members 164. Aperture 162 is circular having a diameter slightly larger than the outer diameter of threaded portion 146 of screw 126 that is the diameter measured to the crown tops of threaded portion 126. Aperture 162 also has an axis 186 as best seen in FIG. 15, that is directly aligned with the axis 188 of threaded portion of screw 126 and the axis 190 of threaded hole 148 of prong 122. Sloping faces 182 and arcuate facing edges directly face one another across aperture 162 so that a diametrical line 191 perpendicular placed across the plane of aperture axis 186 that is perpendicular to inner and outer walls 161 and 163 of wing portions 160 and that is also in alignment with arcuate facing edges 168 is disposed approximately across the midpoint between side walls 178 of arcuate facing edges 168. Aperture 162 is aligned with arcuate facing edges 168 and at approximately right angles to arcuate facing edges 168 spaced back to cross-portion 158 and is in part defined by arcuate cross-portion edges 192. A pair of opposed oblong walls 194 extend inwardly into the spaced between wing portions 170 substantially parallel to diametrical line 191. The facing sides of ovals 194 are substantially tangent to aperture 162. Hollow grooves are formed in cross-portion 158 and are in part defined by ovals 194.

Figure 16:
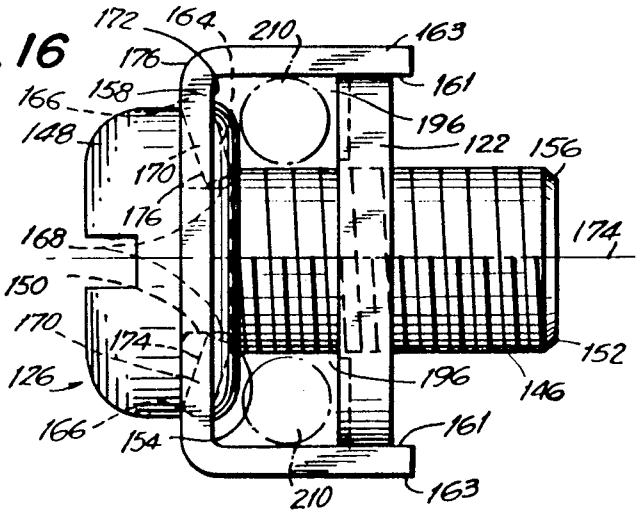
FIG. 16 is a top view of the conductor connecting system showing the conductor in an inserted but non-clamping mode.
Figure 19:
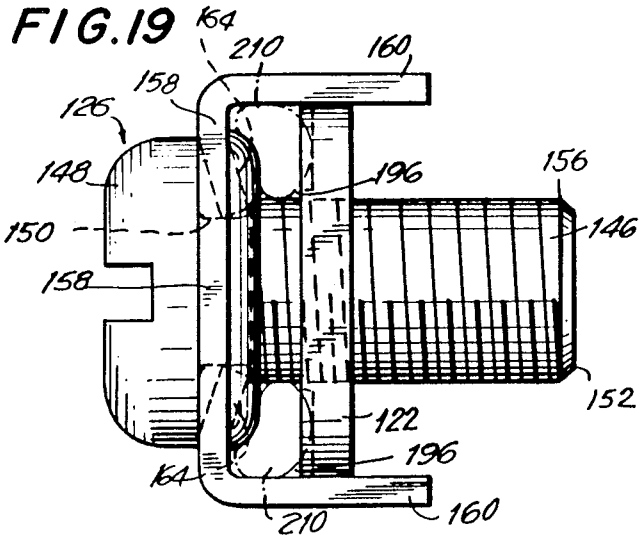
FIG. 19 is a top view of the conductor connecting system showing the conductor in an inserted clamped mode.
Figure 18:
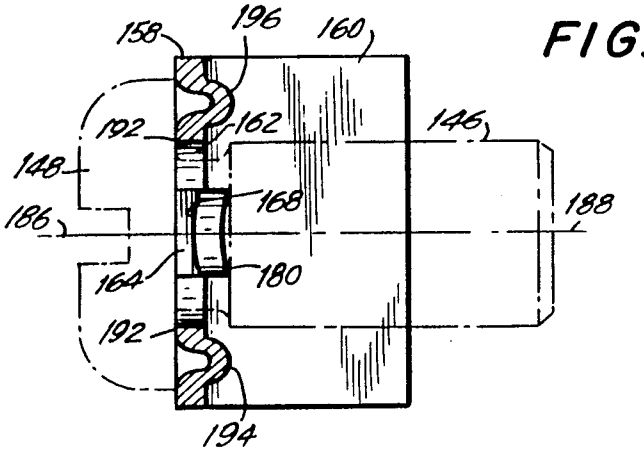
FIG. 18 is a view taken through line 14—14 of FIG. 13.

Screw 126 is shown in its mounted position with bracket 124 and prong 122 in FIGS. 16, 17, and 18, where lead end 152 of threaded portion 146 has been set through aperture 162 and screwed between arcuate facing edges 168 of thread members 164 until trailing end 144 of threaded portion 146 passes arcuate facing edges 168, which then pass into a non-contact alignment with circular recess 150 of screw 126. Trailing end 154 is preferably sharp at the last thread so that reverse screwing of screw 126 from thread members 164 is restricted. In addition, side walls 178 of thread members 164 are set against the crown portion, or outer diameter, of threaded portion 146. Inner facing walls 161 of wing portion 160 are adapted to receive edges 130 of mounting portion 134 in sliding relationship with facing walls 161 being spaced slightly farther apart than the spacing of edges 130 from one another. As screw 126 is screwed inwards, bracket 124 is drawn towards prong 122 with the result that a cavity 196 is formed on either side of threaded portion 146 between cross-portion 158 of bracket 124 and prong 122 for receiving the conductor of wire 13, which as shown in FIG. 1 includes line, neutral, and grounding conductors 207, 208, and 209 respectively. As shown in FIGS. 15-20, stripped wire 13 is designated as conductor 210. As screw 126 is rotated in one direction, generally clockwise as indicated in the drawings, bracket 124 is forced towards prong 122 and cavity 196 is reduced in size, whereby conductor 210 is pinched, or captured, in the cavity. As shown, conductor 210 is illustrated as being wrapped around threaded portion 146. When screw 126 is rotated counterclockwise in an opposite direction, cavity 196 is enlarged and conductor 210 is released from the cavity. When conductor 210 is captured in cavity 196, it is in conducting relationship with prong 122. The final capturing position is illustrated in FIG. 19 where cross-portion 158 of bracket 124 and prong 122 have approached one another and reduced cavity 196 in size to the degree that conductor 210 is tightly pinched in the cavity.

Figure 20:
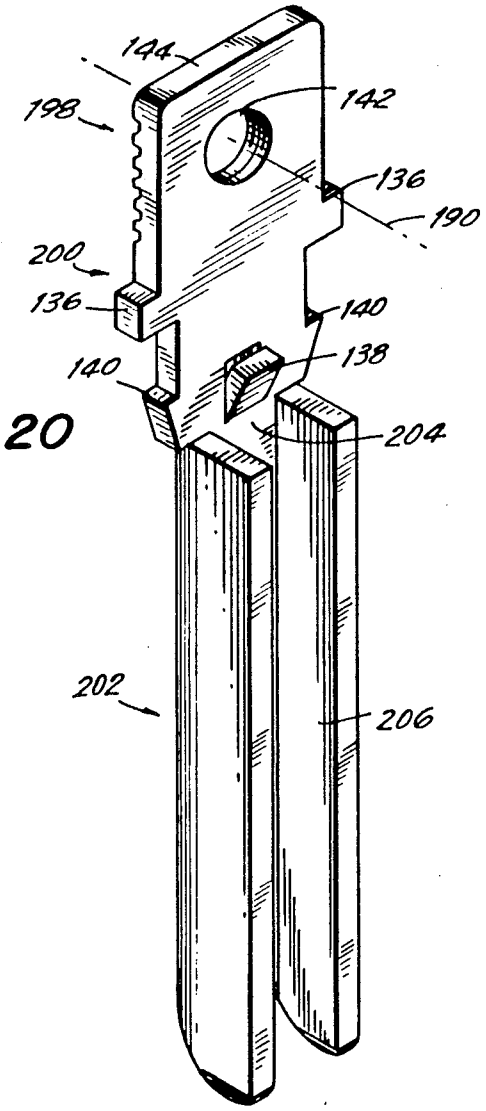
FIG. 20 is a perspective view of a grounding prong used in the conductor connector system.

FIG. 20 shows an additional embodiment that illustrates a grounding prong 198 that is analogous in position and function to grounding prong 27 previously discussed. Grounding prong 198 has a mounting portion 200 that is the same in all respects as mounting portion 134 of prong 110 including shoulders 136, 138, and 140, and hole 142, which is adapted to receive threaded portion 146 of screw 126. Mounting portion 200 is also adapted to be slidingly received by bracket 124 in the manner described by mounting portion 134. Grounding connector portion 202 opposite mounting portion 200 is specifically adapted to connect to a grounding connection and is similar to the grounding connection of grounding prong 27. Specifically, opposed flat sides 204 are reduced in width below shoulders 138 and 140 so that an elongated "U"-shaped connector extends from mounting portion 200. Thus, the grounding prong 27 described in relation to connector 11 can be adapted to connecting system 120 as described.

It is to be appreciated that modifications and variations may be made to the preferred embodiment of the invention described herein without departing from the spirit and scope of the invention that is defined in the following claims:

What is claimed is:

1. A connector for conductively connecting a wire to a receptacle comprising a hollow body having an axial bore for receiving said wire in an axial position, a housing adapted to be received in said body, said housing have a plurality of friction surfaces, at least one movable prong including one of said plurality of friction surfaces, and conductive terminals, cooperative means on said body and said housing for urging said at least one movable prong against said wire radially inward toward said axial position as said housing is inserted within said body, said body having an exterior end and an opposed interior end, said interior end being adapted to receive said housing, and a retaining ring having an axis coaxial with the axis of said axial bore, said retaining ring having an inner cellular surface and an opposed outer surface, said retaining ring comprising at least one cylindrical projection extending axially outward from said inner cellular surface, said cylindrical projection having an opening for receiving a fastener which holds said housing to said body so as to form a unitary connector assembly, and said exterior end of said body having at least one pentagonal recess in which said cylindrical projection can be seated.

2. The connector claim 1 further comprising a plurality of prongs, each of said movable prong and said plurality of groups having one of said friction surfaces and a cam surface thereon, said cam surfaces being disposed for engagement by said body as said housing is mounted in said body, the friction surfaces of said movable prong and said plurality of groups being urged upon said engagement toward a position at which said body is adapted to receive said conductor for securely grasping said conductor.

3. The connector claim 1, further comprising a shoulder projecting from said opposed outer surface of said retaining ring opposite said at least one cylindrical projection, said shoulder functioning to cap said opening of said cylindrical projection.

4. The connector claim 1 further comprising said retaining ring having a central cylindrical axial aperture and said opposed outer surface being a sloping surface which slopes axially outwardly from said central cylindrical axial aperture to the periphery of said retaining ring.

* * * * *